United States Patent [19]

Ariga

[11] 4,294,354

[45] Oct. 13, 1981

[54] PACKAGING CASE

[75] Inventor: Shoji Ariga, Toda, Japan

[73] Assignee: Clarion Co., Ltd., Tokyo, Japan

[21] Appl. No.: 102,078

[22] Filed: Dec. 10, 1979

[30] Foreign Application Priority Data

Dec. 15, 1978 [JP] Japan ..... 53-172497[U]

[51] Int. Cl.[3] ..... B65D 85/00; H01R 43/00

[52] U.S. Cl. ..... 206/335; 206/459; 229/87 H

[58] Field of Search ..... 206/335, 328, 216, 45.12, 206/459; 229/87 H

[56] References Cited

U.S. PATENT DOCUMENTS

| | | | |
|---|---|---|---|
| 1,803,122 | 4/1931 | Modine | 206/216 |
| 2,004,878 | 6/1935 | MacNaught | 206/328 |
| 2,398,901 | 4/1946 | West | 206/216 |
| 3,000,640 | 9/1961 | Strauss | 206/216 |
| 3,707,040 | 12/1972 | Lehmann | 206/328 |

*Primary Examiner*—William T. Dixson, Jr.

*Attorney, Agent, or Firm*—Blanchard, Flynn, Thiel, Boutell & Tanis

[57] ABSTRACT

A package case for packing therein an article to be flush mounted on a fixing structure, which has a pattern of an opening for receiving the article therein so as to flush mount the article on the fixing structure and of threaded holes for screwing the article and has instructions for mounting the article on the pattern.

3 Claims, 2 Drawing Figures

PACKAGING CASE

TECHNICAL FIELD

This invention relates to a package case for packaging therein an article which is to be fixed, when used, to a mounting structure, for example, by fitting into an opening formed on the mounting structure, and more particularly, to an improved package case for a flush-type speaker to be mounted in an opening formed on a door or rear tray of a car.

BACKGROUND ART

In general, in order to fix a flush-type car speaker, an opening for receiving the speaker and threaded holes for fixing the speaker are formed at desired positions on a panel of a door or a rear tray of a car so that a projected back portion of the speaker may be received and fitted in the opening and the speaker may be fixed by screws. For cutting the opening and the holes, it is essential to prepare and use patterns of the opening and the holes because it is difficult to conform the opening and the holes on the panel to the contour of the projected back portion of the speaker and to the screw openings of the speaker, respectively, without using the patterns.

There has therefore been proposed a package case having, on one face thereof, a pattern for the speaker mounting so as to facilitate the installation of the speaker. However, such a known package case has instructions for mounting a speaker on another face of the package case than the face on which the pattern is formed. Therefore, in the actual speaker mounting operation, not only a fragment of the case on which the pattern is formed, but also, a fragment of the case on which the instructions are described must be brought into a limited space in the car. It is difficult to handle the bulky fragments in the narrow space and there is some difficulty even in reading the instructions.

SUMMARY OF THE INVENTION

The present invention has been achieved in view of the facts as mentioned above. It is therefore an object of the present invention to provide a package case having, on at a part of a pattern adapted for a speaker mounting operation, instructions for mounting a speaker so as to allow easy reading of the instructions within a narrow space in a car for facilitating the speaker mounting operation.

BRIEF DESCRIPTION OF THE INVENTION

Figure 1:
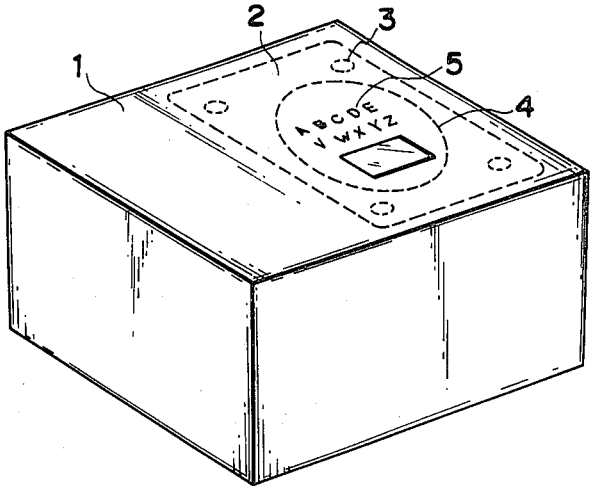
Figure 2:
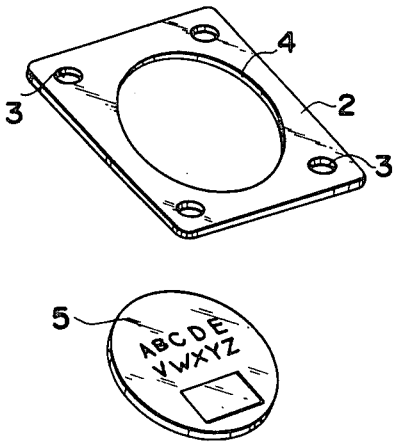

FIG. 1 is a perspective view of a package case in accordance with the present invention; and FIG. 2 is a perspective view of a pattern cut away from the package case illustrated in FIG. 1.

PREFERRED EMBODIMENT OF THE INVENTION

Referring now to the drawings, there is illustrated a preferred embodiment of the present invention. In FIG. 1, numeral 1 designates a package case formed of a plurality of faces, six faces in the illustrated embodiment, made of a cardboard. A pattern 2 for mounting an article contained in the package case is removably formed by perforations on one face of the package case. Numeral 3 designates openings corresponding to threaded holes for screwing a speaker and numeral 4 is an opening corresponding to an opening to be cut for receiving a projected back portion of the speaker. The openings 3 and 4 are all formed by perforations and can be easily cut away. Numeral 5 designates instructions for mounting the speaker which are described on said one face of the case at a portion thereof corresponding to the opening 4 to be cut away from the case.

The speaker packed in the package case in accordance with the present invention is mounted on a car in a manner as described below:

First, the speaker, the article contained in the package case 1, is taken out of the case 1. The pattern 2 is cut away from the case 1, and then the openings 3 for the threaded holes for screwing the speaker and the opening 4 for the opening for receiving the speaker therein are cut away from the pattern 2. The pattern 2 and the fragment 4 bearing the instructions 5 thereon are taken into the car together with the speaker to be mounted. Then, the openings are cut by applying the pattern 2 on the panel of the door or rear tray and the speaker is easily mounted onto the door or the rear tray while reading the instructions 5 described on the fragment 4.

The instructions 5 may alternatively be described at a portion on the pattern 2 other than the portion corresponding to the opening 4.

As apparent from the foregoing, since the instructions are described on the pattern for mounting the article according to the present invention, the instructions are not bulky as different from the conventional package case as mentioned above and easily readable at a place close to the mounting position.

As can be easily understood, the present invention is also applicable to other articles than the speaker as mentioned above.

We claim:

1. A packaging case, comprising: a plurality of walls defining a container for containing an article which is adapted to be flush-mounted on a mounting structure by fastening means, said article having a centrally located, projecting, back portion; at least one of said walls having depicted thereon the outlines of (1) an outer, first pattern having the shape of the perimeter of the zone within which the article is to be flush-mounted on the mounting structure, (2) a second pattern of holes disposed inside said first pattern and substantially corresponding to the locations of the fastening means for fastening the article on the mounting structure and (3) a third pattern of an opening centrally disposed inside said first pattern, spaced from said second pattern and substantially corresponding to the shape of the perimeter of the hole to be cut in the mounting structure for receiving the projecting back portion of the article, said third pattern having marked thereon instructions for mounting the article on the mounting structure, said first pattern being detachable from the remainder of said container so as to be useable as a template for marking the location at which the article is to be mounted on the mounting structure, said second and third patterns being detachable from said first pattern so as to be useable for marking the locations of said holes and said opening, respectively, on the mounting structure.

2. A packaging case as claimed in claim 1, in which said outlines of said first, second and third patterns are depicted by perforation lines through said wall.

3. A packaging case as claimed in claim 1 or claim 2, in which said first pattern has the shape of the zone within which a flush-mounted car audio speaker can be received, said second pattern corresponds to the locations of the fastening means for the speaker and said third pattern has a shape substantially corresponding to the shape of a hole for the rearwardly projecting back portion of the speaker.

* * * * *